US009921033B2

(12) United States Patent
Johnson

(10) Patent No.: US 9,921,033 B2
(45) Date of Patent: Mar. 20, 2018

(54) PEEP SIGHT WITH CONTRASTING/COLOR/TONES FOR GUNS AND BOWS

(71) Applicant: Karl Nathan Johnson, Bend, OR (US)

(72) Inventor: Karl Nathan Johnson, Bend, OR (US)

( * ) Notice: Subject to any disclaimer, the term of this patent is extended or adjusted under 35 U.S.C. 154(b) by 0 days.

(21) Appl. No.: 14/589,181

(22) Filed: Jan. 5, 2015

(65) Prior Publication Data

US 2015/0338190 A1 Nov. 26, 2015

Related U.S. Application Data

(60) Provisional application No. 61/924,585, filed on Jan. 7, 2014.

(51) Int. Cl.
*F41G 1/467* (2006.01)
*F41G 1/08* (2006.01)
*F41B 5/14* (2006.01)

(52) U.S. Cl.
CPC ..... *F41G 1/08* (2013.01); *F41B 5/1419* (2013.01); *F41G 1/467* (2013.01)

(58) Field of Classification Search
CPC ..... F41G 1/08
USPC ..... 33/265; 42/111; 124/87, 90
See application file for complete search history.

(56) References Cited

U.S. PATENT DOCUMENTS 3,859,733 A * 1/1975 Chesnick ..... F41G 1/467 33/265
4,625,422 A * 12/1986 Carlson ..... F41G 1/467 124/87
5,519,941 A * 5/1996 Yusko ..... F41G 1/01 42/133
5,676,123 A * 10/1997 McPherson ..... F41B 5/1419 124/90
6,560,884 B1 * 5/2003 Afshari ..... F41G 1/467 124/87
7,040,027 B1 * 5/2006 Shaffer ..... F41G 1/467 124/87
8,453,336 B2 * 6/2013 LoRocco ..... F41G 1/467 124/87
2007/0050998 A1 * 3/2007 Myers ..... F41G 1/467 33/265
2008/0066328 A1 * 3/2008 Bohn ..... F41G 1/467 33/265
2011/0265778 A1 * 11/2011 Bach ..... F41B 5/14 124/92
2012/0137529 A1 * 6/2012 Minica ..... F41G 1/467 33/265
2013/0081292 A1 * 4/2013 LoRocco ..... F41G 1/467 33/265
2014/0068955 A1 * 3/2014 Orlob ..... F41G 1/467 33/228

(Continued)

*Primary Examiner* — G. Bradley Bennett

(57) ABSTRACT

A sight, especially a peep sight for bows or firearms, having two parts of contrasting colors including a first housing part or a first color and a second insert part of a second, contrasting color/tone, received within a bore formed through the first housing part. The insert can have one of a plurality of selectable aperture widths depending upon the lighting conditions and use desired and may be permanently press fit into the housing or, alternately, threaded into the housing so that the peep includes an insert having contrasting color/tone with the housing to thereby create concentric rings of different colors around the peep hole.

16 Claims, 5 Drawing Sheets

(56) References Cited

U.S. PATENT DOCUMENTS

2015/0226520 A1* 8/2015 Williams ..... F41G 1/02
42/111
2015/0300772 A1* 10/2015 Carson ..... F41A 21/06
42/17

* cited by examiner

PEEP SIGHT WITH CONTRASTING/COLOR/TONES FOR GUNS AND BOWS

BACKGROUND

The disclosure relates generally to peep sights for archery and firearms, and more particularly to such sights with where you have contrasting colors for improved focus in low-lights and general lighting conditions.

A peep sight is a rear reference point to help aim a bow or gun. For a bow a peep sight is usually attached to the bowstring and is essentially a hole which you look through to assist in aiming. For a firearm a peep sight is usually attached to the rear of the firearm and is essentially a hole which you look through to assist in aiming. While it is possible to shoot a bow or firearm without a peep sight, it can be difficult to anchor a bow or firearm back to the same location, or anchor point, which results in less accuracy. Peep sights are very common and most archers, military, officers and sports shooters use them as they allow the shooter to aim faster and more accurately.

One drawback with peeps sights for archery and firearms is that they can be difficult to see through when shooting in low light or poorly lit conditions. Low light and poorly lit conditions are especially common when hunting which occurs mostly at sunrise and sunset, as well as for target archers for in and outdoor competitions and for military, police officers, and SWAT in their daily job. In the low and poorly lit situations, a common problem is that the shooter of the bow or firearm can see the target when not looking through the peep, but when the shooter tried to aim the bow or firearm and looks through the peep which constricts the sight window and makes it difficult to aim or even see through the peep, such encountered when hunting, target competition, and on the job. For example, most peep apertures of aluminum, plastic or titanium are cylindrical bores. In low light conditions, the cylindrical bore impedes visual clarity and target visibility. One solution to this is presented in U.S. Pat. No. 6,981,329 to Strathman, wherein the peep aperture of a plastic or aluminum sight includes two opposing, intersecting frusto-conical recesses which are tapered equally at approximately 35 to 450 degrees to equally deflect light and form an inside, defined edge of the peep sigh aperture. Although the Stratham peep construction can sometimes provide improved target visibility, many times it can deflect too much light. This can sometimes make it difficult to focus through the peep sight, particularly in low and poor lighting conditions. Furthermore, peep sights may tend to blend into the background-especially with colorblind or color impaired shooters—this causing the user to lose sight of the peep and reduce its usefulness.

A need arises, therefore, for a peep design that overcomes some of the drawbacks in the prior art.

SUMMARY

The purpose of this invention is to provide both an interchangeable/non-interchangeable peep for the Archery Industry allowing the user to adjust the aperture of the interchange sight and allow the users eye to focus and see the peep in both low light and mid-day. The dual contrasting colors were selected to allow all skill levels and including color impaired the ability to see the peep. Both designs allow for the dual color. The easy exchange and modularity also allow for optimal user experience.

The invention provides the user the ability to select a peep that fits the user's needs by either allowing easily changing of an insert aperture or selecting a fixed peep. Versions of the invention provide users the ability to focus on the peep due to contrasting colors.

Whereas existing product does not offer the ability to have a dual colored and/or toned product for either interchangeable or non-interchangeable peeps. The designs described herein allow users to select the peep that best suits the user's needs for any style. The modular peeps designed to give the user the ability to easily change the aperture size needed for the shooting condition, providing additional light when shooting in low light. Both peeps have an open back allowing light to gather and funnel and up through the peep face. Finally, the design allows all skill levels to easily change out their peep for one of many aperture sizes that fit in the housing. The contrasting color allows users that can and can't see color to find and focus on the peep in daylight conditions.

The peep sight allows all shooters, including most color impaired, to visually locate the peep and anchor. Allowing the shooter to locate the peep to sight in dim light provides for better accuracy when animals are most likely to be moving.

The foregoing and other objects, features and advantages of the invention will become more readily apparent from the following detailed description of a preferred embodiment of the invention that proceeds with reference to the accompanying drawings.

BRIEF DESCRIPTION OF THE DRAWINGS

The invention will become more readily apparent from the following description of preferred embodiments thereof shown, by way of example only, in the accompanying drawing wherein.

DETAILED DESCRIPTION OF THE EMBODIMENTS

Figure 2:
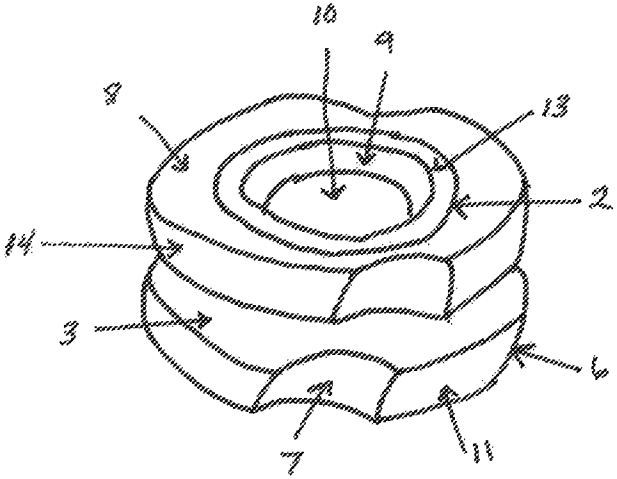
FIG. 2 is a perspective view of a peep assembly showing a housing and threaded housing insert installed and constructed according to embodiments of the invention into the internal housing diameter and insert housing of a contrasting color.

The overall structure in the interchangeable peep includes an outer housing and the option of one of the inner housing inserts. The various inserts sizes provide the shooter with the ability to adjust based on need. The housing and insert can be used together or separate in the interchangeable peep option. The insert ability to adjust is by a standard 7/32 Allen from the bow side. The changeability on the bow side allows the light to funnel to the opening. The non-interchangeable peep still consists of a housing and housing insert, female and male, that are press fit and cannot be interchanged. The bow side of the non-interchangeable peep also funnels the light toward the user providing, additional help in low and poor light. The firearm site is also both interchangeable and non-interchangeable. In the interchangeable the structure includes an outer housing and the option of one of the inner housing inserts. The outer housing can allow for one or two inner housing inserts to be used. The insert ability to adjust is by a standard 7/32 Allen from the open end of the barrel. The changeability on the open-end barrel end allows the light to funnel to the opening. The non-interchangeable peep for the firearm still consists of a housing and a housing insert, female and male, that are press fit and cannot be interchanged.

The open end of the barrel on the non-interchangeable peep also funnels the light toward the user providing additional help in low and poor light. All peeps have the dual color which also offers a sight focusing, and a low light sight visibility component that is critical in the design. All peeps also come in multiple colors and sizes.

Description of Overall Structure of Invention

The overall structure in the interchangeable peep for bows includes an outer housing and the option of one of the inner housing inserts. The various insert sizes and colors and/or tone provide the shooter with the ability to adjust based on need. The housing can be used by the shooter by him or herself if desired. The various outer housing colors and/or tone provide the shooter with the ability to select based on need. The design also offers a quick, easy component exchange and modularity for shooters end needs. The construction of the interchangeable peep is as follows:

- Interchangeable aperture allows for versatility and customization of the peep size
- Dual anodized color allows for easy sight recognition for all shooters and skill levels
- All pieces are precision CNC-machined aluminum construction
- Housing insert has a chamfer of 30 to 60 degrees on each side or 60 to 120-degree combined chamfer
- 2 tone IA (Interchangeable) provides improved sight in low light situations and eases changing the aperture and funneling of light to the shooter
- One embodiment includes black housing (or selected color) and pink or gold insert or selected color
- 35 to 45 Degree angled design for shooter axle-to-axle to bow Peep is 5/16"0 without insert installed. Multiple insert sizes including but not limited to 7/32", 3/16", 9/64", 1/8", 7/64", 5/64", 3/64"
- No special tools needed just an 7/32 Allen-found in most standard kits The non-interchangeable peep for bows still consists of a housing and housing insert (female and male) that are press fit and cannot be interchanged. In this option the user has the standard option to select one that they feel will best meet the needs during all circumstances. The construction of the non-interchangeable peep is as follows:

- Dual anodized color allows for easy sight recognition for all shooters and skill levels
- All pieces are precision CNC-machined aluminum construction
- Housing insert has a chamfer of 30 to 60 degrees on each side or 60 to 120-degree combined chamfer
- One embodiment includes black housing (or selected color) and pink or gold insert or selected color
- 35 to 45 Degree angled design for shooter axle-to-axle to bow
- Fixed apertures sizes include but not limited to 7/32", 3/16", 9/64", 1/8", 7/64", 5/64", 3/64"
- Item weights:
  - Outer part of peep: 7 to 9 grains
  - Large inner 7/32": 2 to 5 grains
  - Medium inner 3/16": 3 to 6 grains
  - Small inner 1/8": 4 to 7 grains
  - Other weights vary by size The interchangeable peep for firearms includes an outer housing winch can be shaped as an elbow or vertical plane and the option of one or two of the inner housing inserts. The various insert sizes and colors and/or tone provide the shooter with the ability to adjust based on need.

The housing can be used by the shooter by him or herself if desired. The various outer housing colors and/or tone provide the shooter with the ability to select based on need. The design also offers a quick, easy component exchange and modularity for shooters end needs. The construction of the interchangeable peep is as follows:

- Interchangeable aperture allows for versatility and customization of the peep size
- Dual anodized color allows for easy sight recognition for all shooters and skill levels
- Housing insert has a chamfer of 30 to 60 degrees on each side or 60 to 120-degree combined chamfer
- All pieces are precision CNC-aluminum construction 2 tone IA (Interchangeable) provides improved sight in low light situations and eases changing, the aperture and funneling of light to the shooter One embodiment includes black housing for selected color) and pink or gold insert or selected color Peep is 5/16" without insert installed. Multiple insert sizes including but not limited to 7/32", 3/16", 9/64", 1/8", 7/64", 5/64", 3/64"

No special tools needed just an 7/32 Allen-found in most standard kits

Item weight:

1/8" Peep: 12 to 16 grains

3/16" peep: 10 to 14 grains

7/32" peep: 9 to 13 grains

Other weights vary by size

The non-interchangeable peep for firearms still consists of a housing and housing, insert (female and male) that are press fit and cannot be interchanged. In this option the user has the standard option to select one that they feel will best meet the needs during all circumstances. The construction of the non-interchangeable peep is as follows:

Dual anodized color allows for easy sight recognition for all shooter and skill levels All pieces are precision CNC-machined aluminum construction Housing insert has a chamfer of 30 to 60 degrees on each side or 60 to 120-degree combined chamfer One embodiment includes black housing for selected color) and pink or gold insert or selected color Fixed apertures sizes include but not limited to 7/32", 3/16", 9/64", 1/8", 7/64', 5/64", 3/64"

Item weight:

Large inner 7/32": 2 to 5 grains

Medium inner 3/16": 3 to 6 grains

Small inner 1/8": 4 to 7 grains

Other weights vary by size

Both the interchangeable and non-interchangeable for both firearms and bows embodiments have the funnels on the bow and open barrel end to allow the light toward the user providing additional help in low and poor light.

Relationship Between the Parts of the Invention

The peep housing in all options accepts the insert, male, housing. One is by thread and the other is machine, press fit. The multiple sizes in both options allow the shooter/end user to select what will give them a desired outcome. In both the interchangeable and non-interchangeable peep the dual color is a critical part of the design. This allows the user to select the color that allows them to see the peep in all lighting conditions. This also works for users that have color seeing issues. The design is based multiple function including but not limited to the method of the housing and inserts fit together. The funnel on the bow and open barrel side that pushes light to the user, along with the dual color. Overall giving the end user a product that is not only brighter, easier to find, which allows them to focus on the shot instead of the peep or pin.

Description of how the Invention Operates/Functions

The peep housing in all options accepts the insert (male) housing. One is by thread the other is machine press fit. The various insert sizes provide the shooter with the ability to adjust based on need. The house and insert can be used together or separate in the interchangeable peep option for both bow and firearms. The insert ability to adjust is by a standard 7/32 Allen for the bow or open barrel side. The changeability on the bow and open barrel side allows the light to funnel to the opening. The bow and open barrel side of the non-interchangeable peep also funnels the light toward the user providing additional help in low and all lighting conditions. Both peeps have the dual color which also offers a sight focusing for all skill levels along with those end users that have color seeing issues and mid-day and low light. Sight visibility components that is critical in the design. All peeps also come in multiple colors and sizes.

Unique Features of the Invention

The components of the interchangeable peep are the sight housing (female) and the housing insert (male) interchangeable components. The dual color from the housing to the insert offers the end user the ability to select the color that works best for their end need which is critical in the design. The bow side and open barrel side adjustment also offers a unique feature which gathers light and funnels it toward the shooter. The interchangeable peep was designed to provide the shooter a solution that offered multiple aperture sizes along with the ability to funnel light through the dual color peep. The non-interchangeable peep offers the same unique features without the ability to adjustability on the aperture side. The non-interchangeable peep is a machine press it to form a single peep which is also dual colored.

How to Make the Invention

Take raw material and machine or mold to designed specifications for all components. Take all components and dip paint, powder coat, anodize, another electro static paint techniques or color die for plastics to achieve the individual color. Combine the insert to achieve the dual color combination.

Alternative Embodiments of Invention

Lighting: Light funnel, reflective finish color, gloss, semi-gloss or matte finish colors, glow in the dark material, anodized color, powder coated colors, dip painted colors and techniques along with plastic color dies in reflective, gloss, semi-gloss or matte, and glow in the dark colors.

Material Options: Exotic materials, titanium, carbon fiber, aluminum, plastic, silicone or any other lightweight materials.

Mechanical Retention Features: Slotted, locking, snap, thread, form fit, machine press fit, injection molded, keyed, loop.

Figure 1:
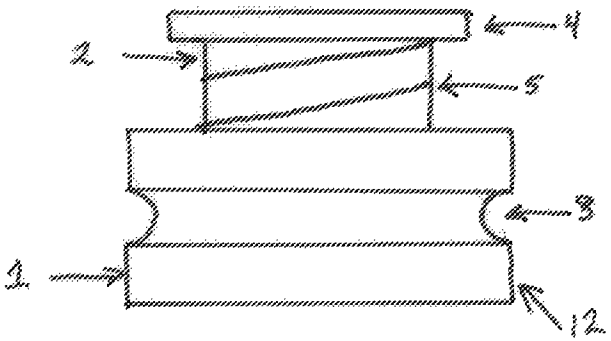
FIG. 1 is a side elevation view showing the threading of the housing insert into the housing to create a peep of contrasting colors and annular groove for sight retention according to teachings of the invention. The side elevation vie\v of the (partial) assembly of the insert 2 with the housing 1.

It is shown in FIGS. 1 and 2 a perspective view of a peep housing 1 showing the threaded insert 2 into which an insert housing 2 of a contrasting color is installed according to teachings of the invention. The sight housing 1 and 15 (FIG. 3) is generally cylindrical but can take an elliptical shape or any suitable shape. To install the peep sight housing 1 or 15 (FIG. 2) one would take equal strands of the bowstring (not shown) which is made of flexible strands. Once sufficient space is made and the bowstring is relaxed or non-stressed the peep sight housing 1 or 15 (FIG. 3) can be located in the string with the strands around the annular retention 7 (FIG. 2) and served in around the retention groove 3. The side surface 14 and 20 (FIG. 4) create a smooth surface to insure the string is not damaged during install or use.

Figure 6:
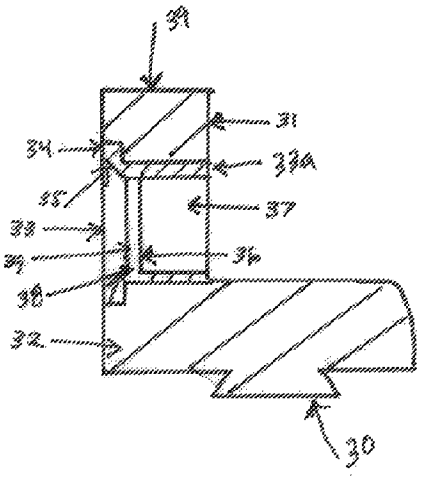
FIG. 6 is a section view showing a gun sight housing configured to accept a non-threaded peep constructed according to embodiments of the invention.

Once the peep is mounted to a bow by the bowstring around 7 (FIG. 2) and or 3 depending on the need. of the user the peep assembly 6 and 19*a* (FIG. 4) can start to be served in. When mounted by angled mounting sight retention groove 7 (FIG. 2) the peep housing 1 and 15 (FIG. 3) can be additionally secured by additional serving (not shown) around retention 3. The rounded edges 12 and 16 (FIG. 3) help insure a smooth surface fir the bowstring. The peep assembly 6 and 6*a* (FIG. 4) is preferable to have a continuous groove 3. Preferably the groove 3 will extend around the periphery of the annular body 6 and 6*a* (FIG. 6). The retention grooves 7 on peep assembly 6 and 6*a* (FIG. 4) run from the front face 8 and 19 (FIG. 4) to the rear face 11 and 19*a* (FIG. 4) in an angler direction.

Figure 3:
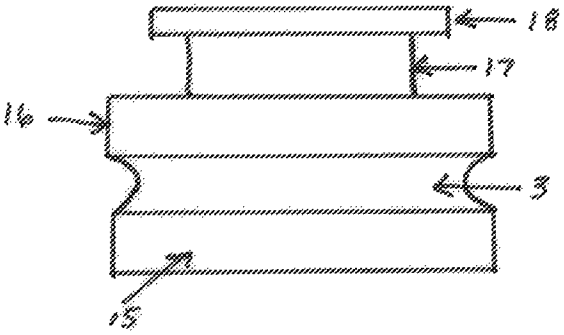
FIG. 3 is a side elevation view showing the non-threaded/press fit of the housing insert into the housing to create a peep of contrasting colors and annular groove for sight retention according to teachings of the invention.

The side view as shown in FIG. 1 shows a cylindrical housing and insert that the user can thread 5 into or removed to select the aperture size 10 (FIG. 2) and color of need. The assembly as shown consists of a peep housing 1, and housing insert 2 which has a face plate 13 (FIG. 2), threads 5 and retention system 3 and 7 (FIG. 2) for installation on a bow. The peep housing 1 and 10 (FIG. 3), housing insert 2 and 15 (FIG. 3) is typically made of an aluminum material but could be formed by any high-strength, light weight and suitable material such as but not limited to titanium, carbon fiber, plastic, silicone and exotic materials and can be of any suitable shape. It will be understood, however, that the internal structures of housing 1 and 15 (FIG. 3), housing insert 2 and 17 (FIG. 3) may be configured in any fashion so long as they adhere to the embodiments and teachings of the invention. The housing insert 2 has a sight bore diameter for coupling with housing 1 as does housing insert 17 (FIG. 3). Housing 1 and 15 (FIG. 3) is 5/16" but can be adjusted to the needed size, shape of the overall construction so long as it adheres to the teaching of the invention.

The housing 1 and 15 (FIG. 3) and housing insert 2 and 17 (FIG. 3) material can be but is not limited to anodizing, powder coating, gloss, semi-gloss, matte, reflective finish, dip painted colors and techniques glow in the dark material and paint, and other electro static painting techniques, and plastic color dies.

FIG. 2 shows how the ambient light is transmitted through the funnel/aperture 10 to the bevel/chamfer 9 to the user eye making this especially useful in low or poor light. The color face plate 4 of the housing insert 2 with multiple color options is intended to create a contrast in color with the housing 1 (FIG. 1) to create contrasting, concentric rings for improved focusing. The housing insert flange 4 seats into the housing 1 with a flush surface making sure the bowstrings are not touched or damaged by the housing insert 2. The aperture size 10 or the diameter of the opening in the housing insert 6 is based on the needs of the end user for both bow and guns and comes in many sizes and colors. The annular retention 3 and 7 of the sight permits the sight to slide easily along the bowstring for user adjustments. However, the annular shape may assume any shape for best retention. The angle on the angular retention 7 for retention is based on the bow, string, and ATA (axle-to-axle) and can vary from 35 to 45 degrees of angle. When drawn back by the user the angle and retention 7 allow the user to see unobstructed and will appear as a cylindrical hole through the peep assembly 6.

Figure 4:
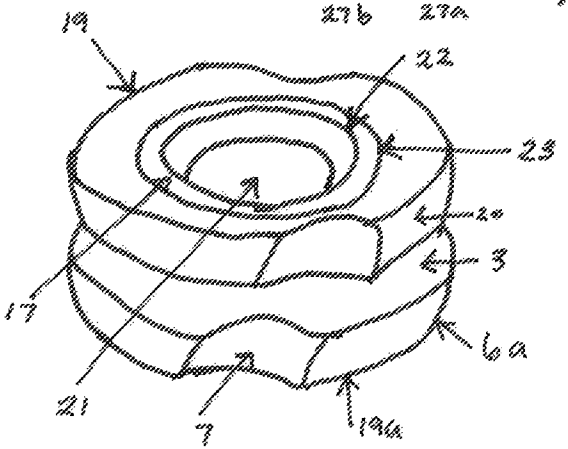
FIG. 4 is a perspective view of a peep assembly showing a housing and non-threaded/press fit housing insert installed and constructed according to embodiments of the invention according to teachings of the invention into the internal housing diameter and insert housing of a contrasting color.

FIG. 3 and FIG. 4 is showing the perspective view of a housing 15 and non-threaded/press fit insert 17 which an insert housing of contrasting color according to the teaching, of the invention. The housing 15 like that of the housing 1 (FIG. 1) is generally cylindrical but can take on any suitable shape. The installation of housing 15 remains the same as housing 1 (FIG. 1). The assembly as shown consists of a peep housing 15, and housing insert 17 which has a face plate 23 (FIG. 4), non-thread/press fit 17 and retention system 3 and 7 (FIG. 3) for installation on a bow. The peep housing 1 (FIG. 1) and 15. and housing insert 2 (FIG. 1) and 17 is typically made of an aluminum material but could be formed by any high-strength, light weight and suitable material as mentioned above in FIG. 2. It will be understood, however, that the internal structures of 1 (FIG. 1) and 15, and housing insert 2 (FIG. 1) and 17 may be configured in any fashion so long as they adhere to the embodiments and teachings of the invention. The housing insert 17 has a sight bore diameter for coupling with housing 15. Like that of housing 1 (FIG. 1) housing 15 is also 5/16" but can be adjusted to the needed size, shape of the overall construction so long as it adheres to the teaching of the invention. The housing insert 17 is then press fit firmly into place in housing 15 with the insert flange 18 seated and then cannot be adjusted by the end user/shooter. Once housing insert 17 is press fit into the housing 15 as shown in FIG. 4 the ambient light is transmitted through the funnel/aperture 21 to the bevel. chamfer 22 to the user eye making it bright, easier, and better for low or poor lighting conditions, yet still another embodiment. When both housing 1 (FIG. 1) and 15, and housing insert 2 (FIG. 1) and 17 are installed together creating a peep assembly 6 and 6*a* they create concentric rings for improved focusing when fully seated within the housing 15. The contrasting colors of the overall peep (now in housing 1 and 15) also create a visual element that color impaired can see. The contrast between the housing 1 (FIG. 1) and 15 and housing insert face plate 13 (FIG. 2) and 23 is what makes it possible for color impaired to recognize the difference and benefits. Like that of housing 1 (FIG. 1) and housing insert 2 (FIG. 1) mentioned above the material can be but is not limited to anodizing, powder coating, gloss, semi-gloss, matte, reflective finish, dip painted colors and techniques glow in the dark. material and paint and other electro static painting, techniques, and plastic color dies.

Figure 5:
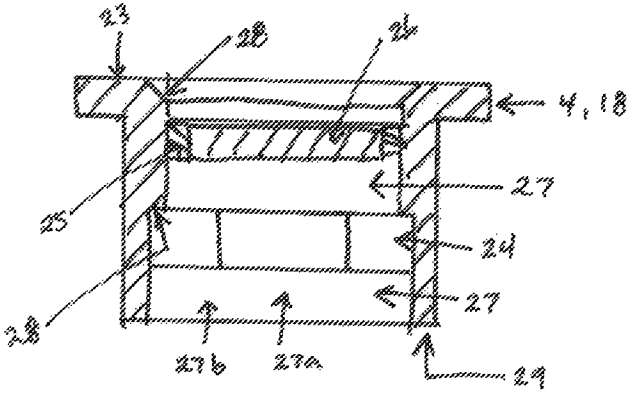
FIG. 5 is a section view of the embodiment of either a threaded or non-threaded insert and showing bevel/chamfer, insert funnel, mounting of the lens housing and lens within the insert, and the 7/32 Allen structure for extracting the insert from the housing and changing to another with a different color and/or aperture size.

The section view of FIG. 5 shows the housing insert of 23 (FIG. 4) and the funnel 27, which leads to the bevel/chamfer 28 and 28*a* within the sighting bore 27*a* of the diameter-selectable size. For this example, housing insert 2 (FIG. 1) will work in the same matter without the Allen 24 adjustment to remove the insert as desired by the user.

As the bow is drawn back to an anchored position ambient. light is funneled 27 through the bow side of the peep 29 and 19*a* (FIG. 4) up through to the bevel/chamfer 28 and 28*a* forcing the rays inward into the upper sight body 27 and out through the face plate 13 and 23 into the user eye. Depending on the user the lens housing 25 with the lens 26 can be added for verifying and or clarify the image. The lens housing 25 and lens 26 can be used with either housing insert 2 (FIG. 1) non-interchangeable (press fit) or 17 (FIG. 3) interchangeable (Threaded) in accordance with the present invention and embodiments, inside of either housing insert 2 (FIG. 1) non-interchangeable (press fit) or 12 (FIG. 3) interchangeable (threaded) is generally cylindrical but can take an elliptical shape or any suitable shape. Within the funnel 27 on the interchangeable (threaded housing) insert 17 (FIG. 3) is a section insert including: a 7/32 Allen structure 24 for extracting the insert from the housing and changing to another with a different color and/or aperture size. It will be understood, however, that the internal structures 27*b* including the Allen structure 24 may be configured in any fashion so long as they adhere to the embodiments and teachings of the invention, and includes but is not limited to slotted, locking, snap, thread, keyed, looped.

Figure 8:
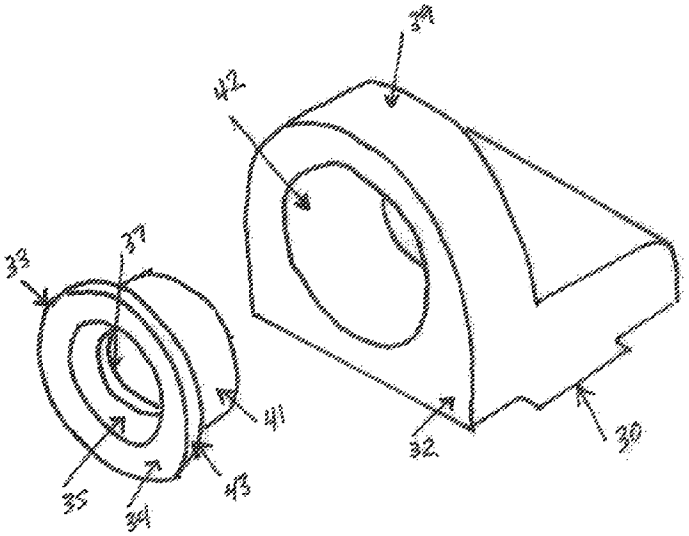
FIG. 8 is a perspective view of a gun sight of a variation and the peep assembly using a non-threaded/press fit peep installed and constructed according to embodiments of the invention.
Figure 7:
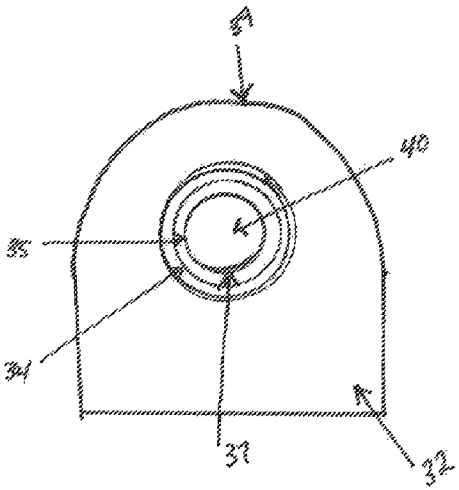
FIG. 7 is a perspective view of a gun sight of a variation and the peep installed using a non-threaded/press fit peep constructed according to embodiments of the invention.

The section view of FIGS. 6-8 shows a gun sight housing 32 showing the top 39 and back 31 configured to accept a housing insert 33 non-interchangeable or press fit providing a contrasting color constructed according to the embodiment of the invention. The sight housing 32 is generally cylindrical but can take an elliptical shape or any suitable shape. The gun sight 32 and FIGS. 9-13 is installed on the gun of choice by the dove tail 30 and 42 (FIG. 9) but could have a set screw 66 (FIG. 13) or other attachment methods 62 (FIG. 14) and 67 (FIG. 14) but are not limited to these methods. For these drawings and for simplicity they are shown without. The housing insert 33 (FIG. 6) and FIGS. 7-15 can be used with an existing sight housing 32, 44 (FIG. 9), and 61 (FIG. 14) and 68 (FIG. 14) once machined out by gunsmith or other professional. For simplicity on the installation of the housing insert 33 (FIG. 6) we are assuming the end user will be using a kit with a pre-machined sight housing 32 coupling to ensure proper fit, The assembly as shown consist of a sight housing 32, and housing insert 33 which has a face plate 34, 33 rear housing insert, bevel/chamfer 35 and 36, the funnel 37 and a location for the lens housing 38 and lens 39 for installation on a gun. The gun sight housing 32 and housing insert 33 is typically made of an aluminum material but could be formed by any high-strength, light weight and suitable material such as but not limited to titanium, carbon fiber, plastic, silicone and exotic materials and can be of any suitable shape. It will be understood, however, that the internal structures of housing insert 33 may be configured in any fashion so long as they adhere to the embodiments and teachings of the invention. Like housing insert 17 (FIG. 3) on the bow these two housing 33 and 17 (FIG. 3) are one in the same but could change based on need, design and uses.

The housing 32 and housing insert 33 material can be but is not limited to anodizing, powder coating, gloss, semi-gloss, matte, reflective finish, dip painted colors and techniques glow in the dark material and paint and other electro static painting techniques, and plastic color dies.

When looking at the housing insert 32 from the open barrel end you see the funnel 26*b*, which leads to the bevel/chamfer 26 and 26*a* within the sighting bore of the diameter-selectable size. As the user anchors the ambient light is funneled 26*b* through the open barrel side of the insert 25 up through to the bevel/chamfer 26 and 26*a* forcing the rays inward into the upper sight body 25*a* and out through the face plate 25*b* into the user eye. Depending on the user the lens housing 27 with the lens 27*a* can be added for verifying and or clarify the image. The lens housing 27 and lens 27*a* can be used with either housing insert 25 non-interchangeable (press fit) or 33 (FIG. 9) interchangeable (Threaded) in accordance with the present invention and embodiments. Inside of either housing insert 33 non-interchangeable (press fit) is generally cylindrical but can take an elliptical shape or any suitable shape.

In FIG. 7 details gun sight housing facing the user as if he/she was anchored and ready for use and configured to accept a housing insert 33 press fit into the gun housing 32 constructed according to the embodiment of the invention and the assembly seated tight by the machine press fit or non-threaded. In looking at the drawing you see the sight housing 32, face plate 34, the bevel/chamfer 35 and the aperture 40 all constructed according to an embodiment of the present invention.

When looking at the assembly of FIG. 8 using the housing insert 33 and the insert inner surface 41 before being press fit 42*a* into the sight housing 24. However, the general shape of the sight housing 32 may assume any shape for this example we are looking at the housing 32 excepting a cylindrical insert housing 33, can be but is not limited to that shape. The funnel 37 leading to the bevel/chamfer 35 leading to the contrasting face plate 34 is shown better to help understand how the user/shooter benefits from the design and embodiments of this invention.

Figure 11:
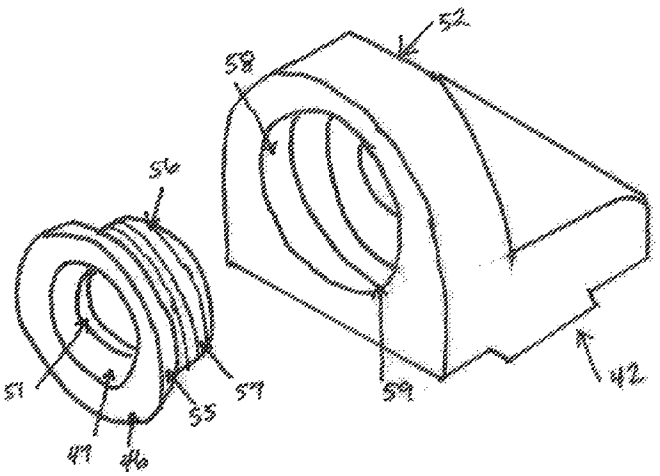
FIG. 11 is a perspective view of a gun sight of a variation and the peep assembly using a threaded peep installed and constructed according to embodiments of the invention.
Figure 10:
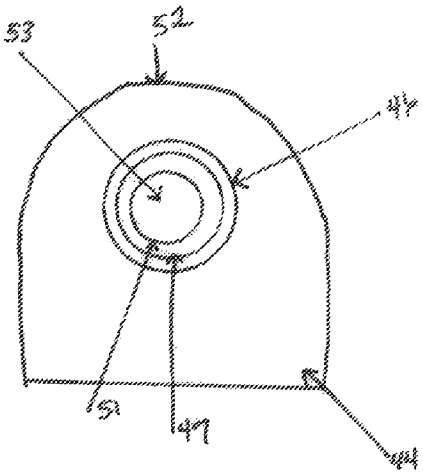
FIG. 10 is a perspective view of a gun sight of a variation and the peep installed using a threaded peep constructed according to embodiments of the invention.
Figure 9:
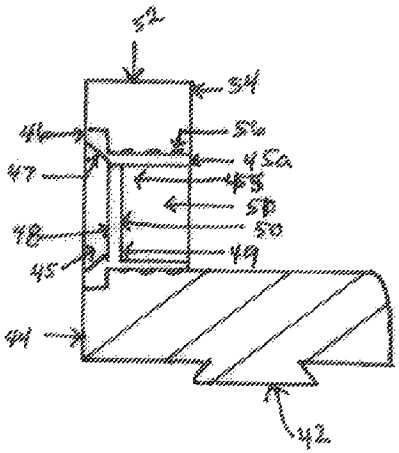
FIG. 9 is a section view showing a gun sight housing configured to accept a threaded peep constructed according to embodiments of the invention.

In FIGS. 9-11 you are looking at yet another embodiment of this invention. With this gun sight housing 44 configured to accept a housing insert 45 interchangeable or threaded providing, a contrasting color constructed according to the embodiment of the invention Like in FIG. 6 the housing 44 and 45 are generally cylindrical but can take an elliptical shape or any suitable shape. The assembly as shown consist of a peep housing 44, and housing insert 45 which has a face plate 46, threaded housing 56, bevel/chamfer 47 and 50, the funnel 51 and a location fur the lens housing 49 and lens 48 as described in FIG. 5 regarding the lens housing 39 and lens 38. The gun sight housing 44 and housing insert 45 is typically made of an aluminum material but could be formed by any high-strength, light weight and suitable material such as but not limited to titanium, carbon fiber, plastic, silicone and exotic materials and can be of any suitable shape. It will be understood, however, that the internal structures of housing insert 44 may be configured in any fashion so long as they adhere to the embodiments and teachings of the invention. Like the housing insert 2 (FIG. 1) on the bow the gun sight house insert 45 are one in the same but could change based on need, design and uses.

The housing 44 and housing insert 45 material can be but is not limited to anodizing, powder coating, gloss, semi-gloss, matte, reflective finish, dip painted colors and techniques glow in the dark material and paint and other electro static painting techniques, and plastic color dies.

As in FIG. 9 the housing insert 45 from rear side 54 see the funnel 51, which leads to the bevel/chamfer 47 and 50 within the sighting bore of the diameter-selectable size. As the user anchors the ambient light is funneled 51 through the rear 54 of the housing insert 45 up through to the bevel/chamfer 50 and 47 forcing the rays inward into the upper sight body and out through the face plate 46 into the user eye. Depending on the user the lens housing 39 with the lens 38 can be added for verifying and or clarify the image. The lens housing 39 and lens 38 can be used with either housing insert 45 non-interchangeable (press fit) or 33 (FIG. 9) interchangeable (threaded) in accordance with the present invention and embodiments. Inside of either housing insert 45 threaded is generally cylindrical but can take an elliptical shape or any suitable shape.

FIG. 10 shows a gun sight housing 44 facing the user as if he/she was anchored and ready for use and configured to accept a housing insert 45 press fit into the gun housing 44 constructed according to the embodiment of the invention and the assembly seated tight by the machine press fit or non-threaded. In looking at the drawing you see the sight housing 44, face plate 46, the bevel/chamfer 47 and the aperture 52 all constructed according to an embodiment of the present invention.

When looking at the assembly of FIG. 11 using the housing insert 45 and the insert inner surface 57 before being threaded into 58 into the sight housing 44. However, the general shape of the sight housing 44 may assume any shape for this example we are looking at the housing 44 excepting a cylindrical insert housing 45, can be but is not limited to that shape. The funnel 51 leading to the bevel/chamfer 47 leading to the contrasting face plate 46 is shown better to help understand how the user/shooter benefits from the design and embodiments of this invention.

Figure 13:
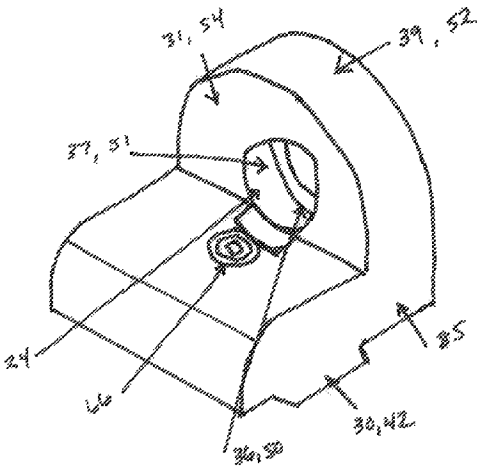
FIG. 13 is a rear elevation view of a gun sight of a variation and the peep assembly using either a threaded or non-threaded peep installed and constructed according to embodiments of the invention.
Figure 12:
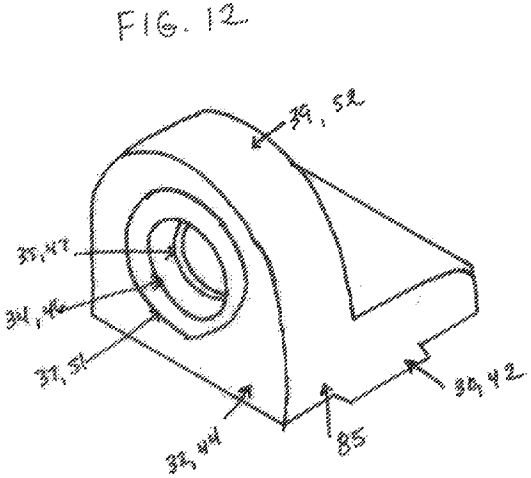
FIG. 12 is a perspective view of a gun sight of a variation and the peep assembly using either a threaded or non-threaded peep installed and constructed according to embodiments of the invention.

In FIGS. 12 and 13 the gun site is showing vet another perspective views of a variation of the gun sight 32 and 44 and peep assembly 85 using an interchangeable 45, or non-interchangeable 33, peep insert in the housing 32 and 44, yet other embodiments of the invention and the assembly of this invention. 34 and 46 having color face plate with multiple color and aperture 53 and 40 options intended to contrast with the housing of FIG. 6-FIG. 15 when received to create concentric rings for improved focusing. The chamfer 35 and 47 as well as the funnel 37 and 51 giving the perspective of the light to the user/shooter. FIG. 13 is a perspective view of the rear housing 31 and 54 and the housing insert 37 and 51 including a 7/32. Allen structure 24 for extracting the insert from the housing and changing to another with a different color and/or aperture size.

Figure 15:
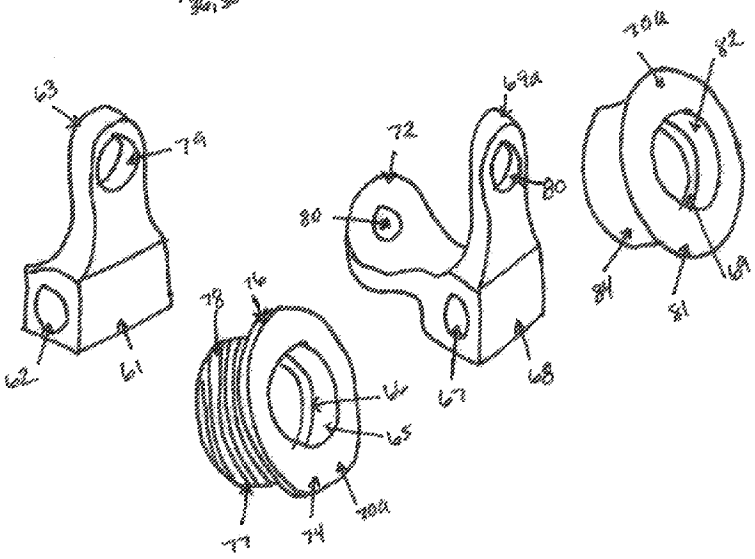
FIG. 15 is perspective view of yet another embodiment of the gun peep sight and either threaded or nonthreaded peep installed and constructed according to embodiments of the invention.
Figure 14:
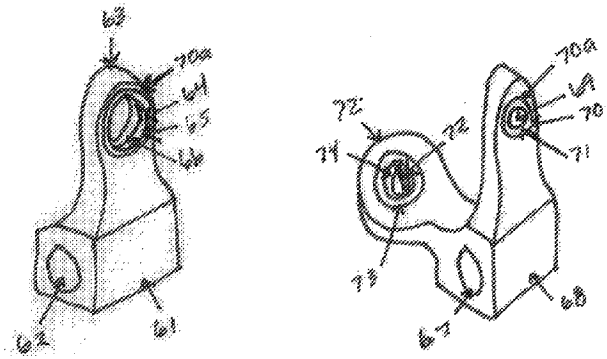
FIG. 14 is perspective view of another embodiment of the gun peep sight and either threaded or nonthreaded peep installed and constructed according to embodiments of the invention.

FIGS. 14 and 15 is a perspective view of yet another embodiment of the gun peep sight and where the housing insert 70*a* would assemble for threaded or non-threaded in the housing 61, yet another embodiments of the invention and the assembly of this invention. The single housing 61 unit would attach by 62 and replace an existing piece. Like in FIG. 6 and FIG. 9 the housing 61 where the housing insert 70*a* is placed is generally cylindrical hole but can take an elliptical, shape or any suitable shape. The assembly as shown consists of a housing 61, and housing insert 70*a* (threaded or non-threaded housing) which has a face plate 64, bevel/chamfer 65, the funnel 66 and a location for the lens as detailed out in FIGS. 6-12. Material details are as described in FIGS. 6-12.

In the single housing 68 the unit would attach by 67 and replace an existing piece. Like in FIG. 6 and FIG. 9 the housing 68 where the housing insert 70*a* is placed is generally cylindrical hole but can take an elliptical shape or any suitable shape. The assembly as shown consists of a housing 68. and. housing insert 70*a* (threaded or non-threaded housing) which has a face plate 70, bevel/chamfer 71, the funnel 69 and a location for the lens as detailed out in FIGS. 6-12. Material details are as described in FIGS. 6-12.

FIG. 15 is a perspective view of the sight before assembly. When looking at the assembly of FIG. 15 using the housing insert 70*a* and the insert inner surface 78 and 84 before being threaded or press fit into 79 and 80 into the sight housing 61 and 68. The funnel 66 and 69 leading to the bevel/chamfer 65 and 71 leading to the contrasting face plate 64 and 70 is shown better to help understand how the user/shooter benefits from the design and embodiments of this invention.

It will be understood that the term "preferably" as used throughout the specification refers to one or more exemplary embodiments of the invention and therefore is not to be interpreted in any limiting sense.

Having described and illustrated the principles of the invention in a preferred embodiment thereof, it should be apparent that the invention can be modified in arrangement and detail without departing from such principles. We claim all modifications and variations coming within the spirit and scope of the invention.

The invention claimed is:

1. A peep sight, comprising:

a housing, the housing having threads and an attachment to allow the housing to attach to one of either a bowstring or a firearm; and an insert configured to fit into the housing, the insert having threads to match the threads on the housing and a chamfer.

2. The sight of claim 1, wherein the insert is of a contrasting color to the housing.

3. The sight of claim 1, wherein the housing is configured to hold inserts of different sizes.

4. The sight of claim 1, wherein the housing has a front and a rear surface able to accept the insert.

5. The sight of claim 1, wherein the chamfer has varying angles on at least one of a front or back of the insert directing light to a user.

6. The sight of claim 1, wherein the attachment comprises an attachment for a firearm and the housing is configured to allow varying sizes apertures and shapes.

7. The sight of claim 6, wherein the attachment for the firearm can a rail, a barrel, a slide, a ribbing, a chamber, an action of the firearm.

8. The said sight of claim 6, wherein the firearm comprises one of a handgun, rifle, shotgun, or tactical weapon.

9. The sight of claim 1, wherein the housing and the insert are one of either interchangeable or fixed from one another.

10. The sight of claim 1, wherein the said insert that creates the apertures can have an approximate size range of ½" to 3/64".

11. The sight of claim 1, wherein the sight further comprises a lens.

12. The sight of claim 1, wherein the housing and insert are made of one of a polymer, metal, or carbon fiber.

13. The sight of claim 1, wherein the sight comprises an archery sight and is configured to engage a string for securing to a bow at angle that varies according to an axel length and needs of the user.

14. The sight of claim 13, wherein the angle has a range of 30 to 50 degrees.

15. The sight of claim 13, wherein the sight is usable on any type of bow.

16. The sight of claim 13, wherein the housing and the insert can be interchangeable with a tool of varying size.

* * * * *